United States Patent [19]

Dardig et al.

[11] Patent Number: 4,726,510

[45] Date of Patent: Feb. 23, 1988

[54] CARTON INSERT FOR PROMOTIONAL ITEMS

[75] Inventors: Scott R. Dardig, Fairfield, Conn.; Thomas P. Hambleton, Thompson Ridge, N.Y.

[73] Assignee: International Paper Co., Purchase, N.Y.

[21] Appl. No.: 930,589

[22] Filed: Nov. 13, 1986

[51] Int. Cl.[4] ..... B65D 5/48

[52] U.S. Cl. ..... 229/120.32; 206/815; 229/132; 229/123.1; 229/125.04; 229/125.17; 229/125.34; 229/160.2

[58] Field of Search ..... 229/15, 27, 43, 132, 229/23 R; 206/815, 459, 804

[56] References Cited

U.S. PATENT DOCUMENTS

| | | | |
|---|---|---|---|
| 1,547,903 | 7/1925 | Cole | 229/15 |
| 1,760,761 | 5/1930 | March | 220/22 |
| 1,820,549 | 8/1931 | Williams | 229/15 |
| 1,903,647 | 4/1933 | Usher | 229/15 |
| 1,935,923 | 11/1933 | Thoke | 229/15 |
| 2,046,562 | 7/1936 | Kane et al. | 206/46 |
| 2,305,087 | 12/1942 | Keller | 229/27 |
| 2,317,651 | 4/1943 | Talbot | 229/14 |
| 2,453,829 | 11/1948 | Blackman | 229/23 |
| 2,948,454 | 8/1960 | Gillmore, Sr. | 229/23 |
| 3,112,855 | 12/1963 | Hennessey et al. | 229/43 |
| 3,182,890 | 5/1965 | Elan | 229/15 |
| 3,288,344 | 11/1966 | Woollen et al. | 229/15 |
| 3,385,503 | 5/1968 | Stump | 229/15 |
| 3,481,527 | 12/1969 | Jacke | 229/43 |
| 3,514,029 | 5/1970 | Powell | 229/15 |

*Primary Examiner*—Stephen Marcus
*Assistant Examiner*—Gary E. Elkins
*Attorney, Agent, or Firm*—Walt Thomas Zielinski

[57] ABSTRACT

An insert which is frictionally positioned in the top end of a barrier carton and dimensioned for ready removal through a carton pour spout. The insert includes a central panel and a peripheral flange which is hingedly connected to the central panel at an embossed score line. Removal of the insert is facilitated by the provision of outwardly curved edges in the peripheral flange. A knock-out opening is provided in the central panel for pulling the insert through the carton pour spout.

8 Claims, 7 Drawing Figures

10
12
18
22
24
30
20
26
42
54
56
62

CARTON INSERT FOR PROMOTIONAL ITEMS

DESCRIPTION

1. Field of Invention

This invention generally relates to compartment inserts for cartons and more, particularly, a paperboard insert for barrier sealed cartons which provides a compartment for receiving promotional items.

2. Background Art

In packaging granulated or pulverized food products, and particularly breakfast cereals, it has long been food industry practice to package promotional items. For example, in offering breakfast cereals directed to the childrens' market, toys and novelties are packaged in the product box and featured in product literature.

Inserts for forming compartments in cereal boxes are known in the prior art. U.S. Pat. Nos. 3,112,855 to Hennessey and 2,317,651 to Talbot are representative of prior art arrangements in which inserts including central panels and peripheral securing flanges are recessed in the open top end of cartons to form receptacles. Such inserts are typically heat sealed within cartons to effect a barrier closure.

It will be recognized that use of such hermetically sealed inserts hinders ready access to the container contents. Such arrangements also introduce packaging complexities and added production expense.

The present invention is directed to an improved insert for barrier cartons having a structure of uncomplex design which may be readily positioned within and removed from the open end of the carton. The insert of the invention has particular application for a barrier carton of the type disclosed in U.S. patent application Ser. No. 06/883,882, filed July 9, 1986, to International Paper Company, assignee of the present application, which is directed to a carton including a pressure sensitive membrane closure which provides a reclosable pour spout.

Accordingly, it is the broad object of the present invention to provide an improved carton insert for promotional items of uncomplex design which has particular application in barrier cartons.

A more specific object of the invention is to provide an insert which may be readily removed from a barrier carton having a pour spout closure structure.

DISCLOSURE OF THE INVENTION

In the present invention, these purposes, as well as others which will be apparent, are achieved generally by providing a carton insert for promotional items including a central panel and a hingedly connected peripheral flange which is dimensioned for frictional placement within the top end of a barrier carton. The peripheral flange is connected to the central panel at an embossed score line and includes sections having outwardly curved exterior edges. These edges are contoured to facilitate ready removal of the insert from the carton.

In a preferred embodiment of the invention, the insert is specifically configured for use in a carton of parallelepiped configuration including a membrane liner which provides a pour spout. The membrane includes a pressure sensitive reclosure section which pivots outwardly to define the pour spout. The insert is provided with a rectangular dimension including front, rear and side flange sections which are respectively attached to the central panel at longitudinal and transverse score lines.

Outwardly curved exterior edges in the front and rear flange sections facilitate sliding movement of the insert through the carton pour spout. A knock-out opening is provided in the central panel in the area of the carton pour spout to facilitate removal of the insert.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figure 1:
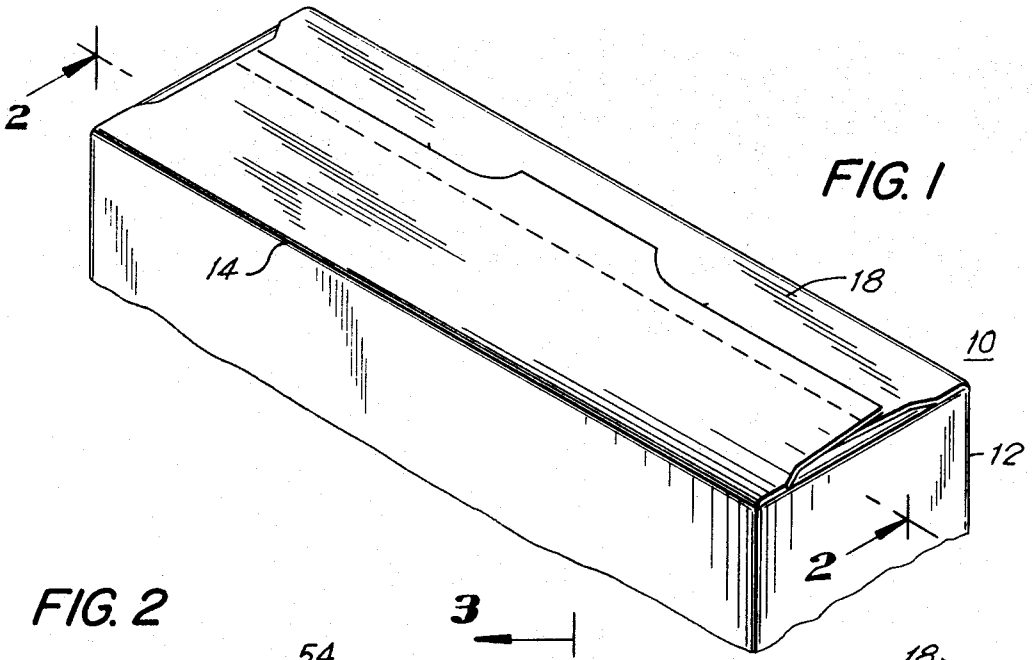
FIG. 1 a perspective view of a carton closure for a rectangular parallelepiped carton including a promotional insert according to the invention.

Referring now to the drawings, a carton 10, including an insert according to the invention, generally designated 40 is shown in FIGS. 1–3 and 5–7. The preferred carton construction is in accordance with U.S. application Ser. No. 06/883,882 to International Paper Company, assignee of the present application. The promotional insert, illustrated in FIG. 3, will be described following a discussion of the carton construction.

The carton 10 which has a parallelepiped configuration and is fabricated of a conventional polyethene extrusion coated folding carton paperboard, includes a body portion formed by an upright boundary wall 12, a top end peripheral edge 14 which defines a carton opening 16, and a cover 18 for closing the top end of the carton. A reclosable membrane liner 20 fabricated of moisture barrier coated paper is heat sealed at marginal areas 22 to interior surfaces of the carton cover. The membrane 20 includes hingedly connected attachment sections 24, 26 which define a pour spout 30. Attachment section 26 may include a pressure sensitive adhesive in the marginal areas for reclosure of the pour spout.

Figure 4:
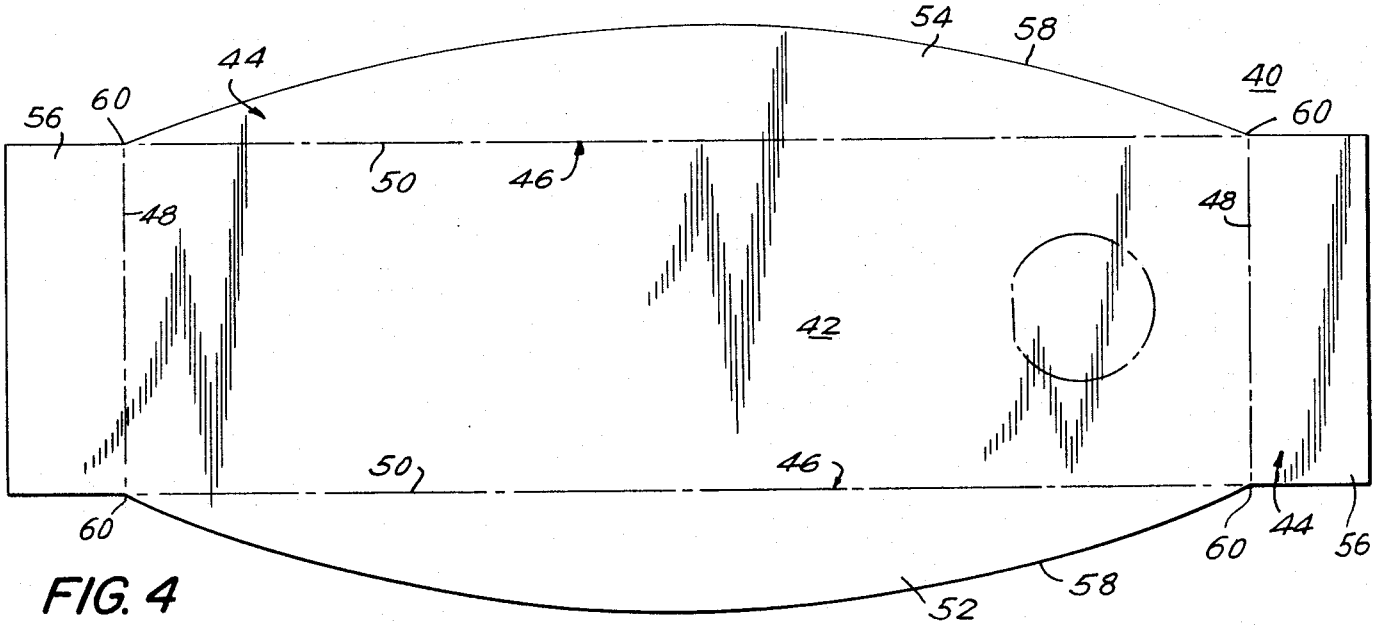
FIG. 4 is a plan view of the promotional insert of the invention.

The promotional insert 40 of the invention includes a central panel 42 of rectangular configuration dimensioned for frictional placement within the carton opening 16, and a peripheral flange 44 which is hingedly attached to the central panel at an embossed score line 46. See FIG. 4.

The embossed score line 46 includes transverse and longitudinal portions 48, 50 which border the periphery of the central panel 42. Peripheral Flange 44 includes generally opposing front, rear and side sections 52, 54, and 56 which are respectively connected to the longitudinal and transverse score line portions.

Front and rear flange sections 52, 54 each have an outwardly curved exterior edge 58 including opposing ends 60 which meet the transverse score line portions 48. Each edge 58 forms an acute angle with axes defined by the opposing transverse score line portions 48. Side flange sections 56 have a generally rectangular configuration.

Figures 5, 6, 7:
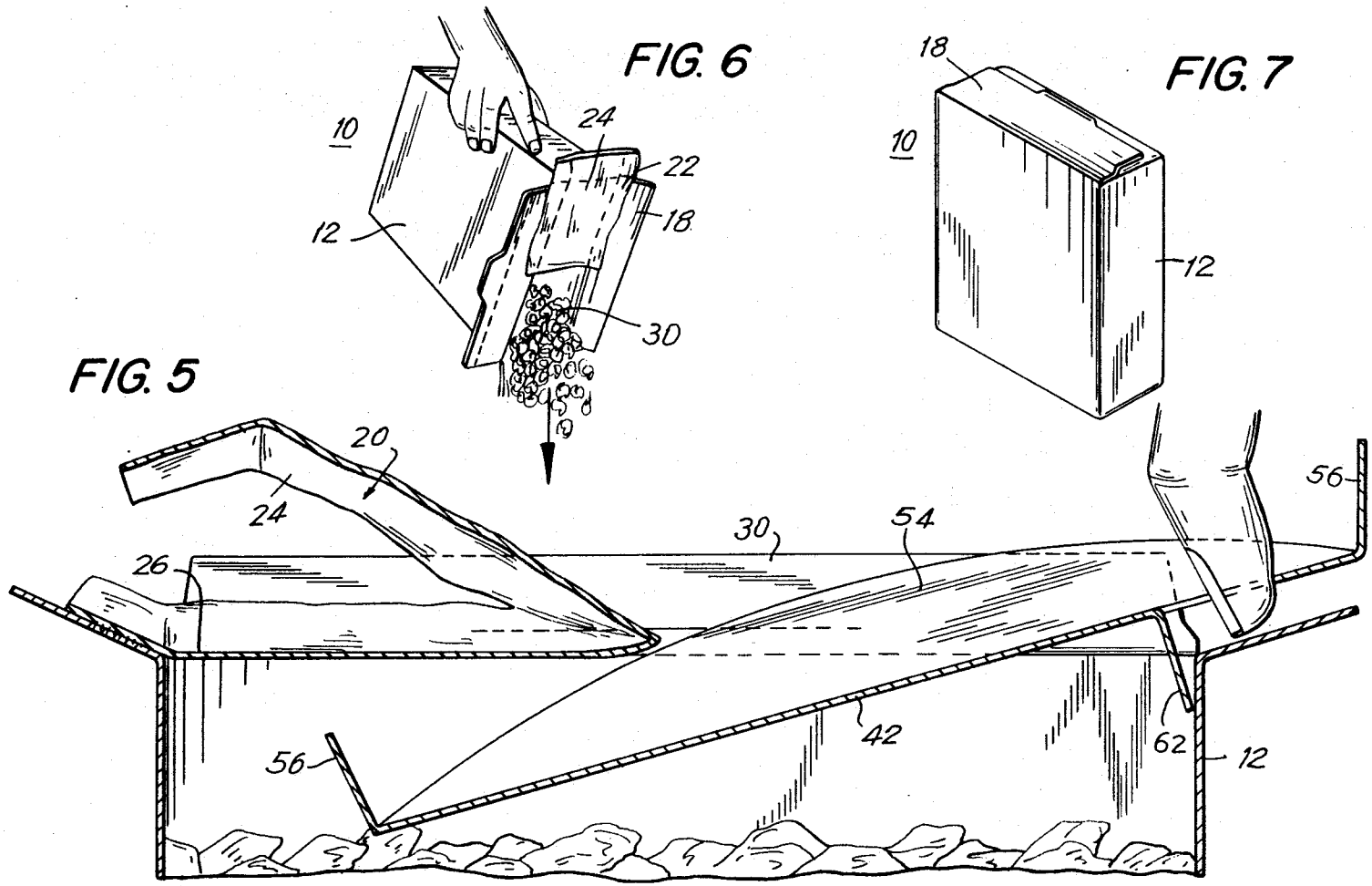
FIGS. 5–7 illustrate the manner in which the promotional insert is removed from the carton through a carton pour spout.

A perforated knock-out 62 having a circular configuration is provided in the central panel 42 to facilitate removal of the insert from the carton, see FIG. 5. Knock-out 62 is located in proximity to the carton pour spout 30 for ready access to the insert.

Figure 2:
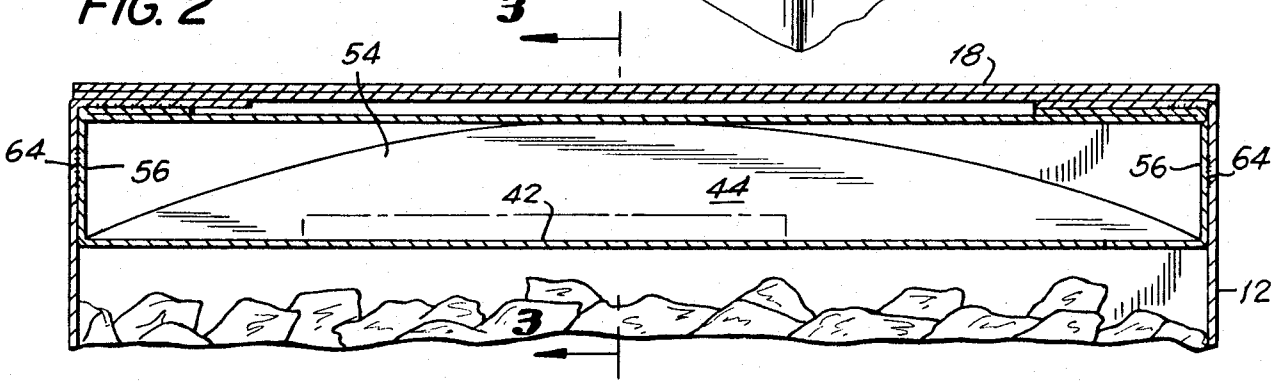
FIG. 2 is a vertical cross-section of the carton showing the position of the promotional insert taken along the line 2—2 of FIG. 1.
Figure 3:
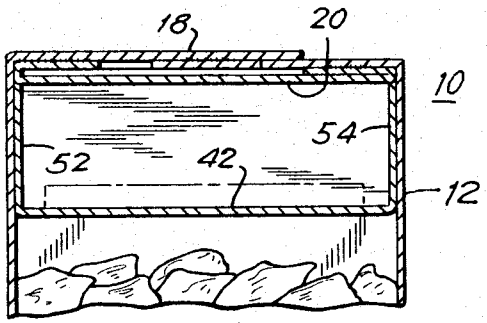
FIG. 3 is a horizontal cross-section of the carton taken along the line 3—3 of FIG. 2.

The promotional insert 40 is frictionally arranged within the open end of the carton 16 with the peripheral flange 44 overlying interior boundary wall surfaces of the carton, see FIGS. 2 and 3. In order to secure the insert in position dots of conventional hot melt glue 64 are applied to the side flange sections 56. The insert when positioned in the carton defines a receptacle for receiving promotional items.

A preferred promotional insert 40 is fabricated of a val-v-coat bleached white paperboard having a thickness in the range of 14–16 pts. It will be recognized that other conventional paperboard materials may be employed in fabricating the insert.

FIGS. 5–7 illustrate the manner in which the insert 40 is removed from the carton. First, membrane attachment section 24 is pivoted outwardly to define the pour spout and provide access to the insert. The insert is then removed through use of the knock-out 62. Advantageously, contoured exterior edges 58 of the peripheral flange 44 permit sliding movement of the insert through the pour spout without obstruction.

From the foregoing, it will be appreciated that the present invention provides an insert 40 which achieves the objects stated heretofore. In particular, an insert of uncomplex design is provided for receiving promotional items which may be readily positioned within and removed from the top end of the carton without difficulty. These objectives are achieved by provision of contoured exterior edges 58 which coact with knock-out 62 for ready removal of the insert through the carton pour spout.

Numerous modifications are possible in light of the above disclosure. For example, the drawings show an insert having a rectangular configuration for use in a parallelepiped carton. Other carton and insert configurations are within the scope of the disclosure.

Therefore, although the invention has been described with reference to certain preferred embodiments, it will be appreciated that other insert constructions may be devised, which are nevertheless within the scope and spirit of the invention as defined by the claims appended hereto.

We claim:

1. A promotional insert for use in an open ended carton including a closure cover, said insert comprising a central panel dimensioned for frictional placement within the carton, and a peripheral flange hingedly attached to said central panel at an embossed score line for securing said central panel at a spaced location from the carton opening, said embossed score line including opposing transverse and longitudinal portions, said peripheral flange including front and rear sections which are connected to the longitudinal portions, and side sections which are connected to the transverse portions, said front and rear sections each having an outwardly curved exterior edge extending between and terminating at opposing ends which meet said transverse score line portions, each exterior edge forming an acute angle with an axis defined by said opposing transverse portions at said opposing ends to thereby facilitate removal of the promotional insert from within the carton.

2. A promotional insert according to claim 1, further comprising means for pulling the insert through the open end of the carton, said pulling means including a perforated knock-out in said central panel.

3. A promotional insert according to claim 2, wherein said perforated knock-out has a circular configuration.

4. A promotional insert according to claim 1, wherein the carton has a generally parallelepiped configuration and said central panel has a rectangular configuration.

5. A promotional insert according to claim 4, wherein said carton includes a barrier seal membrane liner which provides a carton pour spout, and said knock-out panel is located in proximity to said pour spout.

6. A promotional insert according to claim 3 wherein said side flange sections have a generally rectangular configuration.

7. A promotional insert according to claim 6, further comprising dots of hot melt glue applied to said side flange sections for securing the insert within the carton.

8. A promotional insert according to claim 6, wherein the insert is fabricated of paperboard having a thickness in the range of 14–16 pts.

* * * * *